US009689558B2

(12) United States Patent
Matsunaga

(10) Patent No.: US 9,689,558 B2
(45) Date of Patent: Jun. 27, 2017

(54) ATTACHMENT AND LIGHTING APPARATUS

(71) Applicant: KOITO MANUFACTURING CO., LTD., Tokyo (JP)

(72) Inventor: Takashi Matsunaga, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 187 days.

(21) Appl. No.: 14/458,663

(22) Filed: Aug. 13, 2014

(65) Prior Publication Data

US 2015/0049499 A1 Feb. 19, 2015

(30) Foreign Application Priority Data

Aug. 14, 2013 (JP) ..... 2013-168706

(51) Int. Cl.
*F21V 19/00* (2006.01)
*F21S 8/10* (2006.01)
*F21Y 115/10* (2016.01)

(52) U.S. Cl.
CPC ..... *F21V 19/0025* (2013.01); *F21S 48/1104* (2013.01); *F21S 48/1109* (2013.01); *F21S 48/1159* (2013.01); *F21S 48/328* (2013.01); *F21Y 2115/10* (2016.08)

(58) Field of Classification Search
CPC ..... F21V 19/001; F21Y 2101/02
See application file for complete search history.

(56) References Cited

U.S. PATENT DOCUMENTS

2005/0180157 A1* 8/2005 Watanabe ..... F21S 48/1104 362/543
2010/0208480 A1* 8/2010 Matsunaga ..... F21S 48/1109 362/509

FOREIGN PATENT DOCUMENTS

JP 2010-192139 A 9/2010

* cited by examiner

*Primary Examiner* — Elmito Breval
(74) *Attorney, Agent, or Firm* — Sughrue Mion, PLLC

(57) ABSTRACT

An attachment adapted to fix a semiconductor light source unit to a support member is provided. The attachment includes a frame having an opening periphery portion defining an opening to allow light emitted from the semiconductor light source unit to pass through the opening, and first and second conductive terminal pieces extending from the opening periphery portion. The first conductive terminal piece extends in one direction to contact a first power receiving portion of the semiconductor light source unit. The second conductive terminal piece extends in the same direction to contact a second power receiving portion of the semiconductor light source unit.

7 Claims, 8 Drawing Sheets

ATTACHMENT AND LIGHTING APPARATUS

CROSS-REFERENCE TO RELATED APPLICATION

The present application claims priority from Japanese Patent Application No. 2013-168706 filed on Aug. 14, 2013, the entire content of which is incorporated herein by reference.

FIELD OF INVENTION

The present invention relates to an attachment for fixing a semiconductor light source unit to a support member, and to a lighting apparatus having the semiconductor light source unit and the attachment.

DESCRIPTION OF RELATED ART

A related art light apparatus is a vehicle lamp having a semiconductor light source unit. The semiconductor light source unit has a semiconductor light emitting device such as a light emitting diode (LED). The semiconductor light source unit is fixed on a support member. An example of the support member is a heat sink for dissipating the heat generated due to the light emission. An attachment is used when fixing the semiconductor light source unit to the support member. The attachment has a conductive terminal piece. One end of the conductive terminal piece contacts a power receiving portion of the semiconductor light source unit. Power is supplied from the outside to the semiconductor light source unit through the conductive terminal piece and the power receiving portion (see, e.g., JP 2010-192139 A).

BRIEF SUMMARY

Illustrative aspects of the present invention provide an attachment for a compact semiconductor light source unit, and a lighting apparatus having the semiconductor light source unit and the attachment.

According to an illustrative aspect of the present invention, an attachment is provided to fix a semiconductor light source unit to a support member. The attachment includes a frame having an opening periphery portion defining an opening to allow light emitted from the semiconductor light source unit to pass through the opening when the semiconductor light source unit is fixed to the support member, a first conductive terminal piece extending from the opening periphery portion, and a second conductive terminal piece extending from the opening periphery portion. The first conductive terminal piece extends in one direction to contact a first power receiving portion of the semiconductor light source unit when the semiconductor light source unit is fixed to the support member. The second conductive terminal piece extends in the same direction to contact a second power receiving portion of the semiconductor light source unit when the semiconductor light source unit is fixed to the support member.

According to another illustrative aspect of the present invention, a lighting apparatus is provided. The lighting apparatus includes a support member, a semiconductor light source unit disposed on the support member, and the attachment described above.

Other aspects and advantages of the invention will be apparent from the following description, the drawings and the claims.

DETAILED DESCRIPTION

Figure 1:
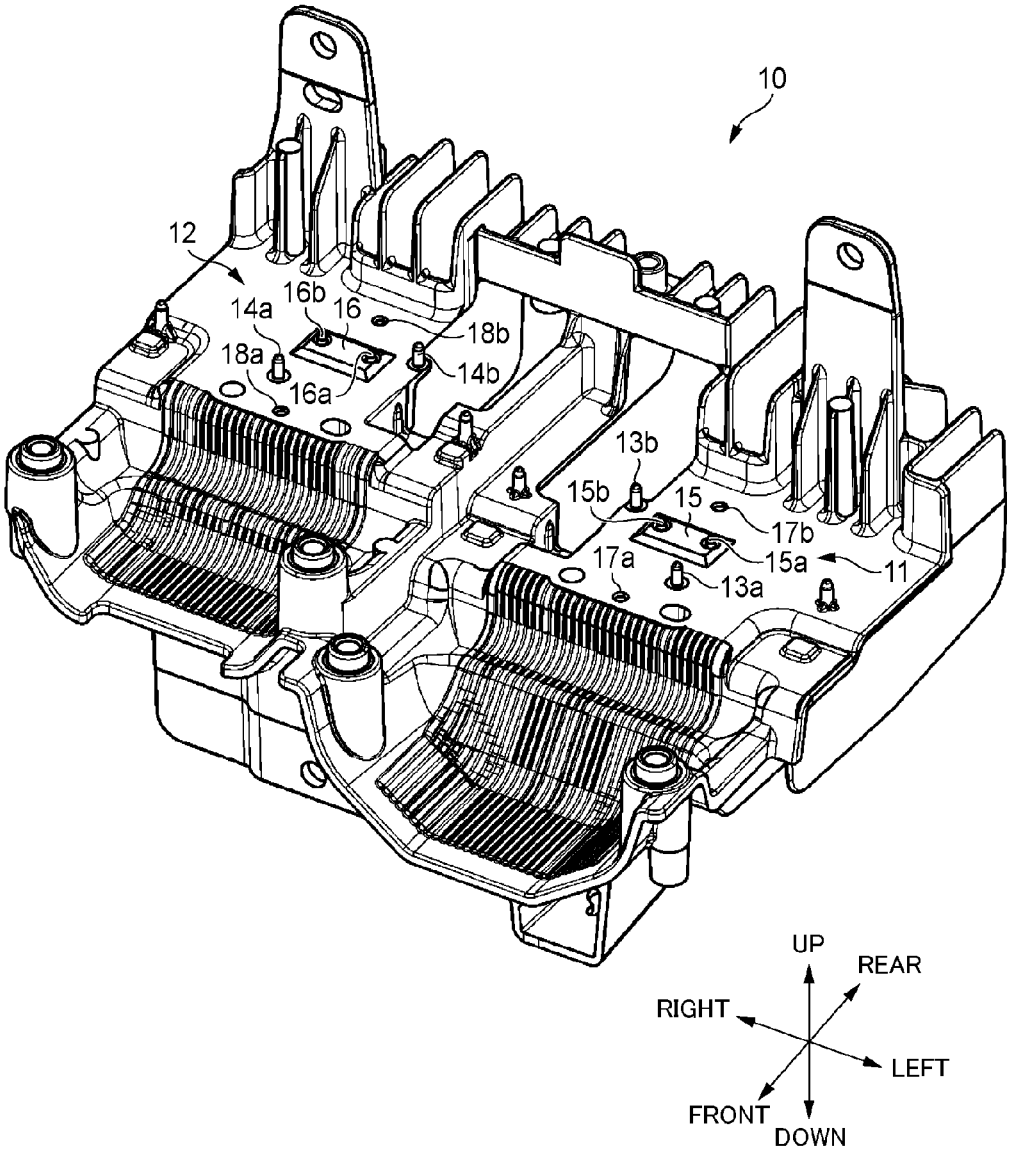
FIG. 1 is a perspective view of a support member of a lamp unit according to an exemplary embodiment of the present invention.

Hereinafter, exemplary embodiments of the present invention will be described in detail with reference to the drawings. In the drawings, some elements are not to scale in order to have a recognizable size. In the following description, "right" and "left" are defined based on the view from a driver's seat.

FIG. 1 shows a support member 10 of a lamp unit 1 (see FIG. 4), as an example of a lighting apparatus. The lamp unit 1 is provided in, for example, a vehicle headlamp. The support member 10 includes a left support section 11 and a right support section 12. A front positioning pin 13*a* and a rear positioning pin 13*b* are provided to extend upward from an upper surface of the left support section 11. A front positioning pin 14*a* and a rear positioning pin 14*b* are provided to extend upward from an upper surface of the right support section 12.

A left light source mounting portion 15 is provided between the front positioning pin 13*a* and the rear positioning pin 13*b* in the left support section 11. A left positioning pin 15*a* and a right positioning pin 15*b* are extended upward from an upper surface of the left light source mounting portion 15. A right light source mounting portion 16 is provided between the front positioning pin 14*a* and the rear positioning pin 14*b* in the right support section 12. A left positioning pin 16*a* and a right positioning pin 16*b* are extended upward from an upper surface of the right light source mounting portion 16.

A front screw hole 17*a* is formed in front of the front positioning pin 13*a* in the left support section 11. A rear screw hole 17*b* is formed to the rear of the rear positioning pin 13*b* in the left support section 11. A front screw hole 18*a* is formed in the front of the front positioning pin 14*a* in the right support section 12. A rear screw hole 18*b* is formed to the rear of the rear positioning pin 14*b* in the right support section 12.

Figure 2:
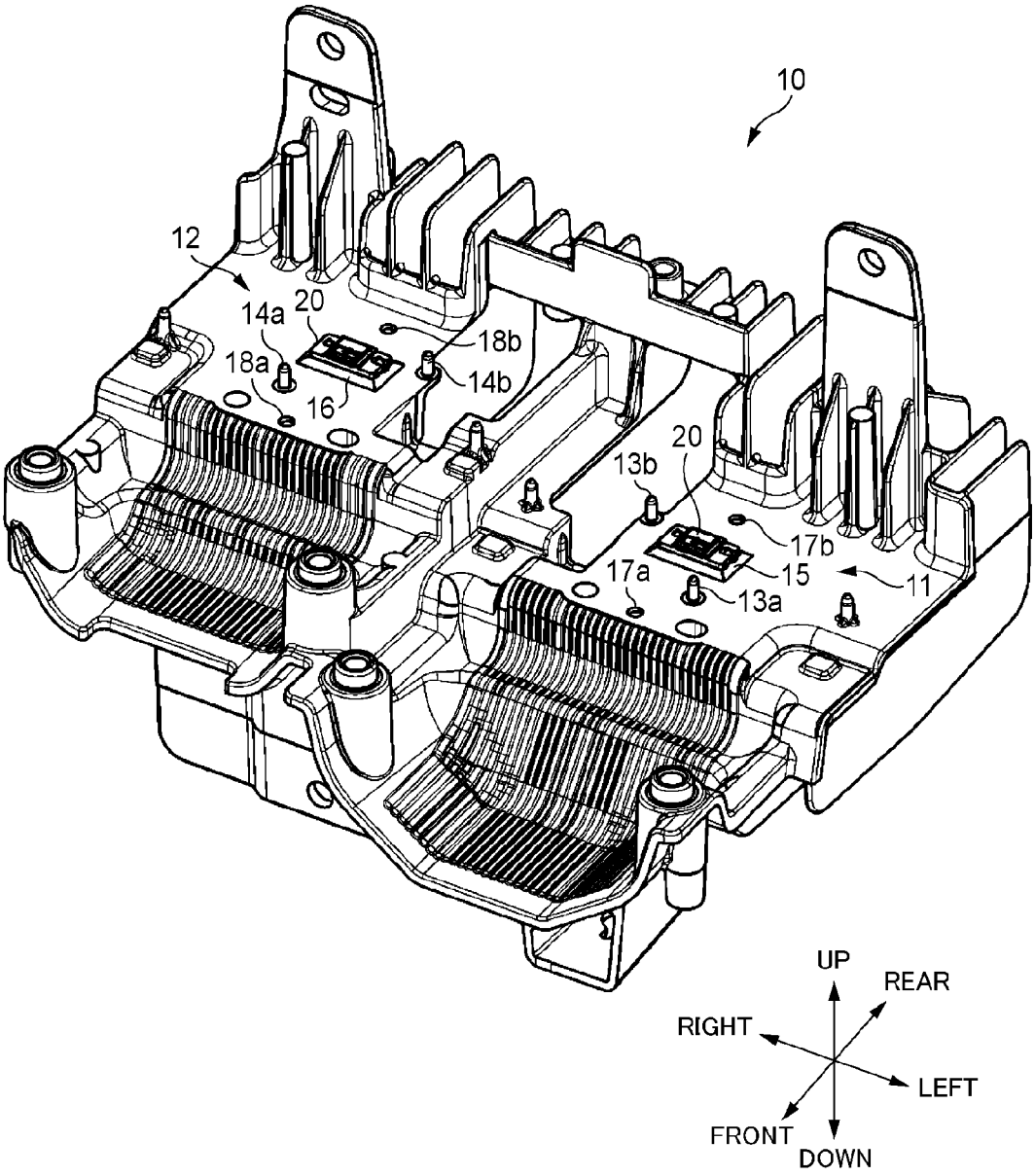
FIG. 2 is a perspective view of the support member on which semiconductor light source units are mounted.

As shown in FIG. 2, semiconductor light source units 20 having the same configuration are mounted on the left light source mounting portion 15 of the left support section 11 and the right light source mounting portion 16 of the right support section 12 respectively. A configuration of the semiconductor light source units 20 and a method of mounting the semiconductor light source units 20 on the left light source mounting portion 15 and the right light source mounting portion 16 will be described later in detail.

Figure 3:
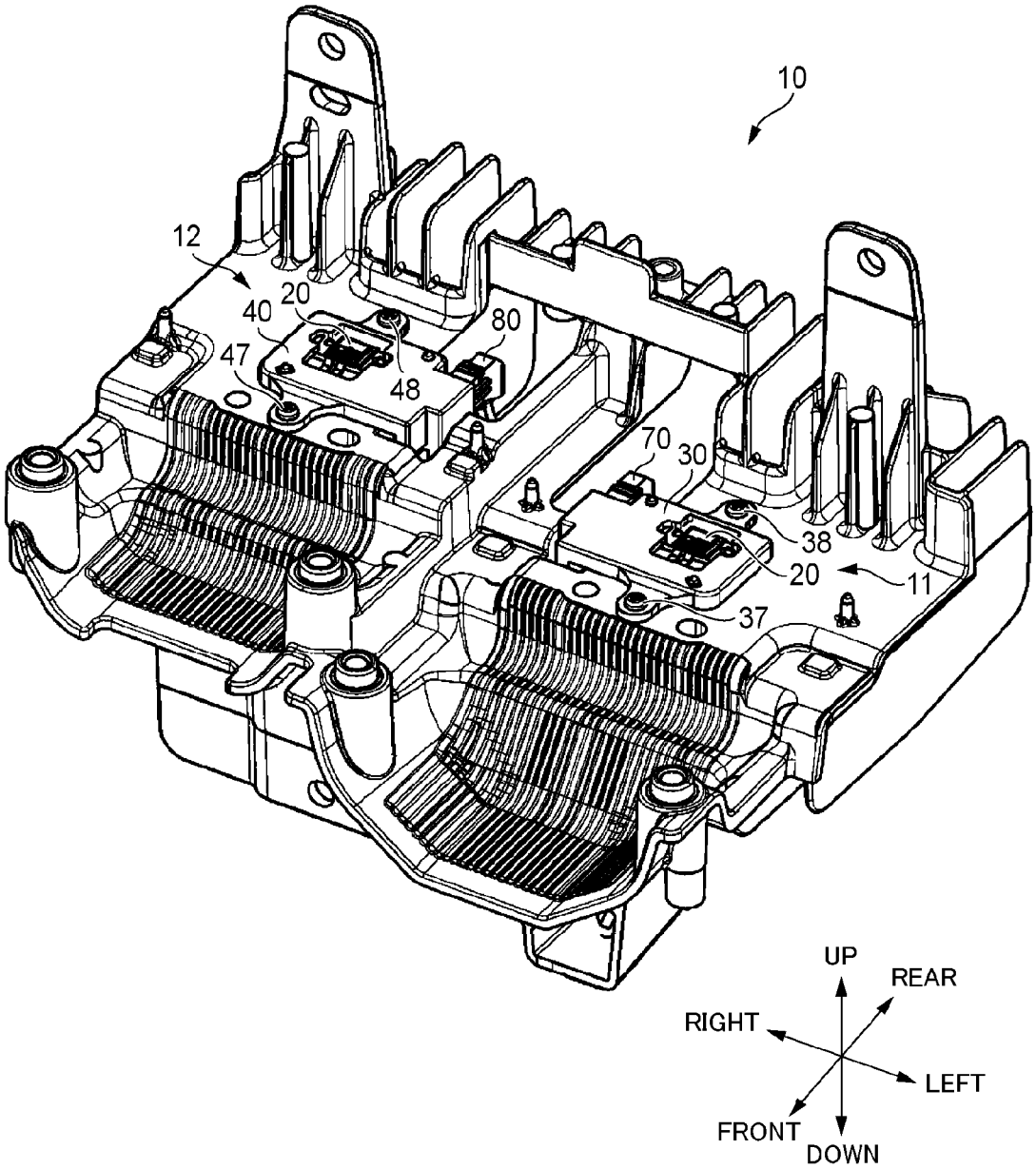
FIG. 3 is a perspective view of the support member on which attachments are mounted.

As shown in FIG. 3, the semiconductor light source unit 20 is fixed to the left light source mounting portion 15 by attaching a left attachment 30 to the left support section 11. The semiconductor light source unit 20 is fixed to the right light source mounting portion 16 by attaching a right attachment 40 to the right support section 12. A configuration of the left attachment 30 and the right attachment 40 and a method of attaching the left attachment 30 and the right attachment 40 to the left support section 11 and the right support section 12 will be described later in detail.

Figure 4:
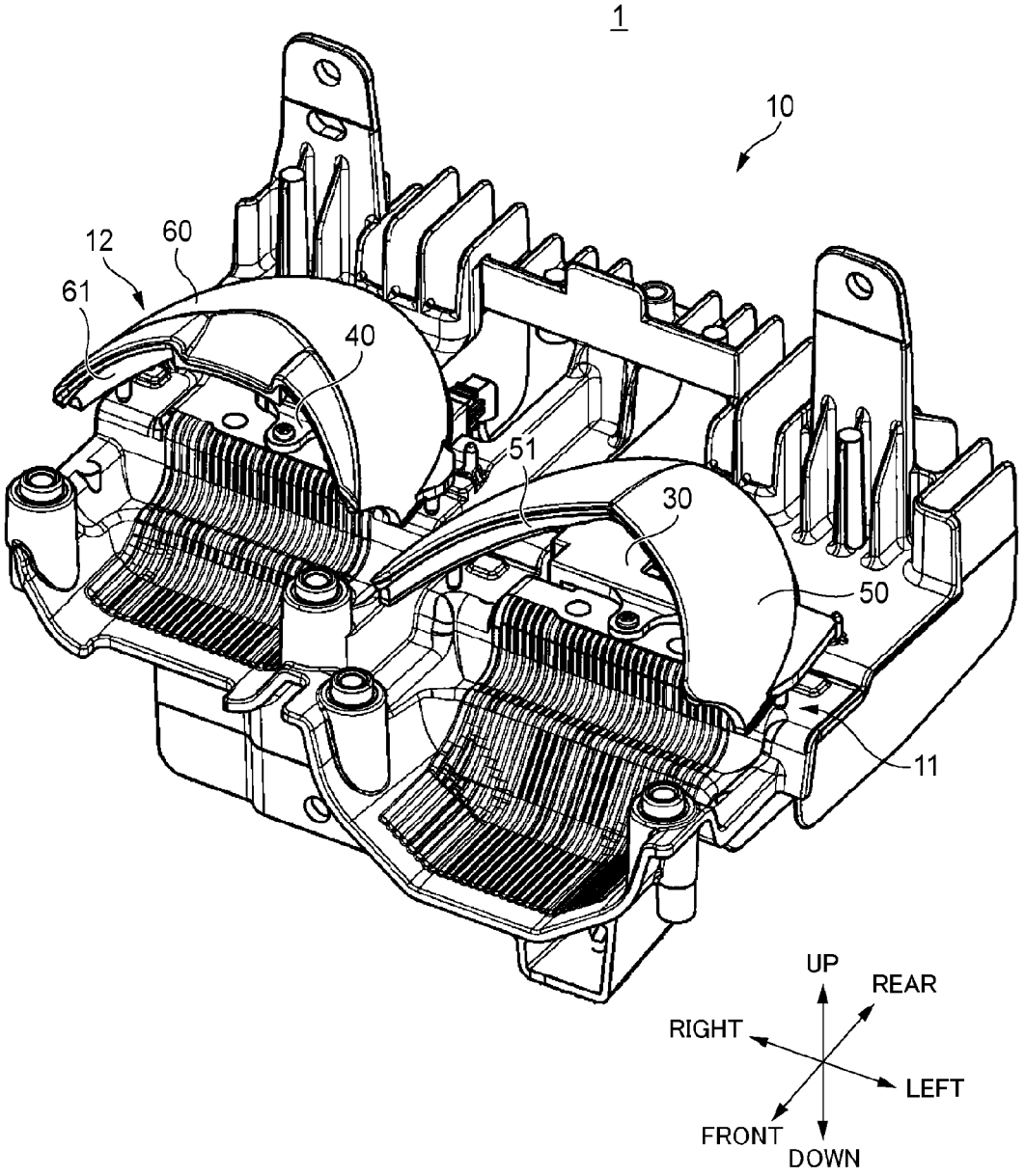
FIG. 4 is a perspective view of the support member on which reflectors are mounted.

As shown in FIG. 4, a left reflector 50 is mounted on the left support section 11 and a right reflector 60 is mounted on the right support section 12, whereby the lamp unit 1 is provided.

An inner surface of the left reflector 50 is configured as a reflecting surface 51. The left reflector 50 is arranged such that the reflecting surface 51 faces the semiconductor light source unit 20 fixed by the left attachment 30. The light emitted from the semiconductor light source unit 20 is reflected by the reflecting surface 51 toward a region in front of the semiconductor light source unit 20. An inner surface of the right reflector 60 is configured as a reflecting surface 61. The right reflector 60 is arranged such that the reflecting surface 61 faces the semiconductor light source unit 20 fixed by the right attachment 40. The light emitted from the semiconductor light source unit 20 is reflected by the reflecting surface 61 toward a region in front of the semiconductor light source unit 20.

Lenses (not shown) may be provided in front of the left reflector 50 and the right reflector 60 respectively to control distribution of light passing through the lenses. The lamp unit 1 is mounted on a vehicle. The light emitted from each of the semiconductor light source unit 20 irradiates a region in front of the lamp unit 1.

Figure 5A:
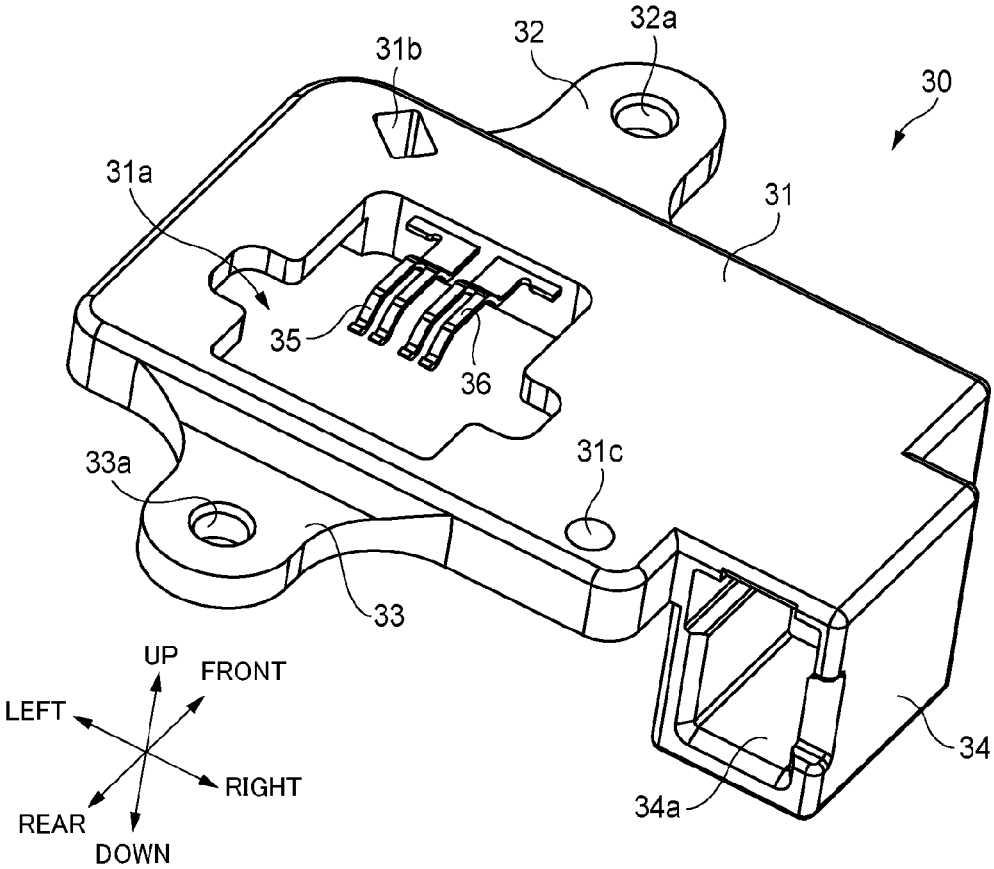
FIG. 5A is a perspective view one of the attachments.

FIG. 5A is a perspective view of the left attachment 30, as seen obliquely from the rear right. The left attachment 30 includes a frame 31 made of an electrically insulating material such as resin. The frame 31 has an opening 31*a*, a front positioning hole 31*b* and a rear positioning hole 31*c*. The opening 31*a*, the front positioning hole 31*b* and the rear positioning hole 31*c* are formed to extend completely through the frame 31 in the up-down direction.

The left attachment 30 further includes a front fixing tab 32 and a rear fixing tab 33. The front fixing tab 32 extends forward from a front end of the frame 31. The front fixing tab 32 has a front fixing hole 32*a*. The front fixing hole 32*a* is formed to extend completely through the front fixing tab 32 in the up-down direction. The rear fixing tab 33 extends rearward from a rear end of the frame 31. The rear fixing tab 33 has a rear fixing hole 33*a*. The rear fixing hole 33*a* is formed to extend completely through the rear fixing tab 33 in the up-down direction.

The left attachment 30 further includes a connector portion 34. The connector portion 34 is provided on the right side of the frame 31, forming a one-piece structure together with the frame 31. The connector portion 34 has a connecting hole 34*a* opened toward the rear. As shown in FIG. 6B, connecting terminals 34*b*, 34*c* are arranged inside the connecting hole 34*a*.

As shown in FIG. 5A, the left attachment 30 further includes a left conductive terminal piece 35 and a right conductive terminal piece 36. The left conductive terminal piece 35 and the right conductive terminal piece 36 are made of a conductive material such as copper, and are provided integrally with the frame 31 and the connector portion 34 by, for example, an insert molding. Portions of the left conductive terminal piece 35 and the right conductive terminal piece 36 are exposed to the opening 31*a* of the frame 31. The remaining portions of the left conductive terminal piece 35 and the right conductive terminal piece 36 extend inside of the frame 31, and are physically and electrically connected to the connecting terminals 34*b*, 34*c* provided in the connector portion 34, respectively.

Figure 5B:
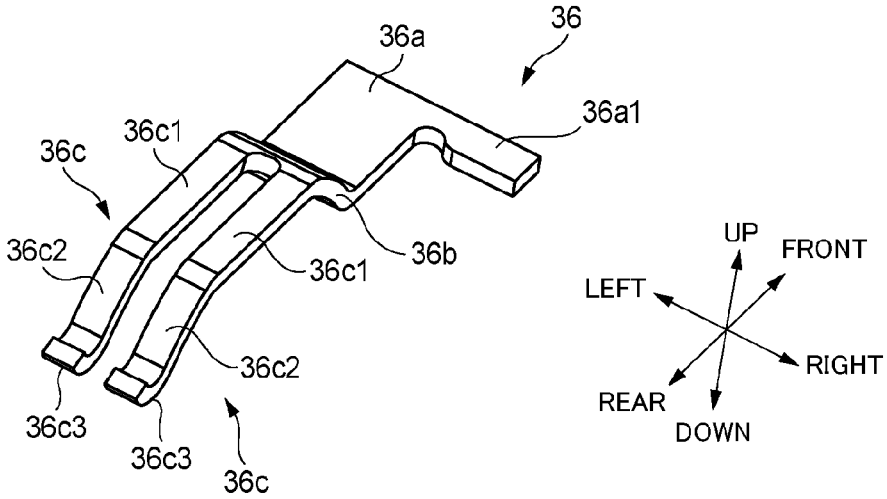
FIG. 5B is a perspective view of an exposed portion of a conductive terminal piece of the attachment.

FIG. 5B is an enlarged perspective view of the portion of the right conductive terminal piece 36 exposed to the opening 31*a*. The exposed portion includes a base end portion 36*a*, an inclined portion 36*b* and a pair of arms 36*c*.

The base end portion 36*a* is clamped between molds in the process of insert molding described above. The base end portion 36*a* is formed to have flat surface so that the base end portion is supported in a stable manner when clamped between the molds. Accordingly, it is possible to ensure a stable molding quality. The width of the base end portion 36*a* is widened only to the right at the front portion of the base end portion 36*a*, thereby forming a widened portion 36*a*1.

The inclined portion 36*b* extends rearward and obliquely upward continuously from the rear end of the base end portion 36*a*. The pair of arms 36*c* extends rearward continuously from the rear end of the inclined portion 36*b*. Each of the arms 36*c* includes a flat portion 36*c*1, an inclined portion 36*c*2 and a contact portion 36*c*3. The flat portion 36*c*1 extends rearward continuously from the rear end of the inclined portion 36*b*. The inclined portion 36*c*2 extends rearward and obliquely downward continuously from the rear end of the flat portion 36*c*1. The contact portion 36*c*3 is formed continuously from the rear end of the inclined portion 36*c*2. According to this configuration, the pair of arms 36*c* has a resiliency that allows displacement to some extent in the up-down direction.

Figure 6A:
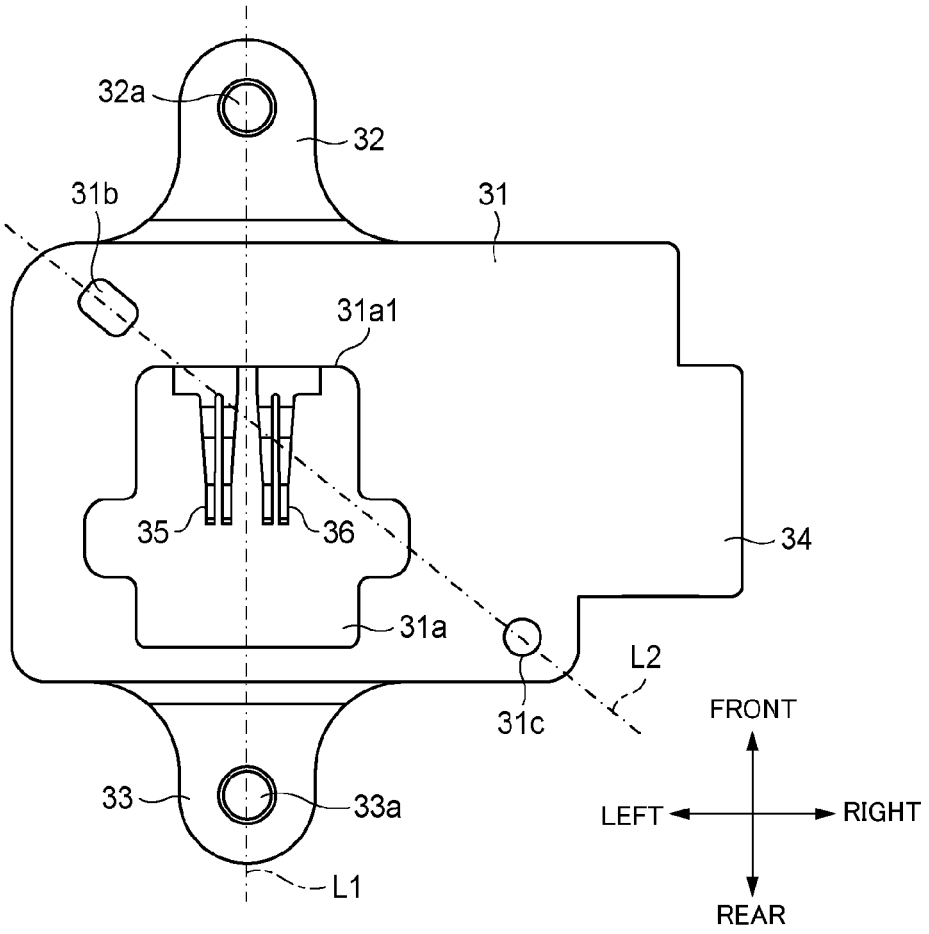
FIG. 6A is a plan view of the attachment.
Figure 6B:
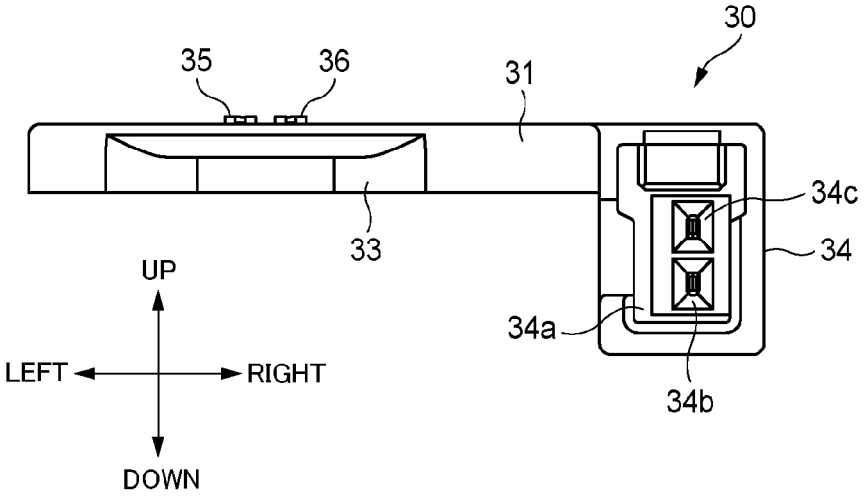
FIG. 6B is a rear view of the attachment.

As shown in FIG. 6A, the exposed portions of the left conductive terminal piece 35 and the right conductive terminal piece 36 are bilaterally symmetrical in a plan view. That is, a width of a base end portion of the exposed portion of the left conductive terminal piece 35 (corresponding to the base end portion 36*a*) is widened only to the left at the front portion of the base end portion, thereby forming a widened portion (corresponding to the widened portion 36*a*1). Other features of the exposed portion of the left conductive terminal piece 35 are substantially the same as those of the exposed portion of the right conductive terminal piece 36, and therefore detailed description thereof is omitted.

Each of the base end portions of exposed portions of the left conductive terminal piece 35 and the right conductive terminal piece 36 is located at a front side 31*a*1 of the opening periphery portion that defines the opening 31*a*. That is, the left conductive terminal piece 35 and the right conductive terminal piece 36 both extend rearward from the front side 31*a*1 of the opening periphery portion. The exposed portions of the left conductive terminal piece 35 and the right conductive terminal piece 36 are configured in a bilaterally symmetrical manner such that each of the base end portions is widened only on one side, whereby they can be arranged as close as possible. That is, it is possible to use the semiconductor light source unit 20 in which a distance between a left power receiving portion 24 and a right power receiving portion 25 is narrow due to the demand for downsizing.

The front fixing tab 32 and the rear fixing tab 33 extend parallel to the extending direction of the left conductive terminal piece 35 and the right conductive terminal piece 36.

The front fixing hole 32*a* of the front fixing tab 32 is located in front of the left conductive terminal piece 35 and the right conductive terminal piece 36. The rear fixing hole 33*a* of the rear fixing tab 33 is located to the rear of the left conductive terminal piece 35 and the right conductive terminal piece 36. The front fixing hole 32*a* and the rear fixing hole 33*a* are arranged such that a straight line L1 connecting the centers of these fixing holes 32*a*, 33*a* extends through a space between the left conductive terminal piece 35 and the right conductive terminal piece 36.

The front positioning hole 31*b* is obliquely located in the front left of the opening 31*a*. The rear positioning hole 31*c* is obliquely located in the rear right of the opening 31*a*. Specifically, the front positioning hole 31*b* and the rear positioning hole 31*c* are arranged such that a straight line L2 connecting the centers of these positioning holes 31*b*, 31*c* obliquely extend across the opening 31*a*. The front positioning hole 31*b* is formed as an elongated hole whose longitudinal direction corresponds to the direction of the straight line L2. The rear positioning hole 31*c* is formed as a circular hole.

As shown in FIG. 3, the left attachment 30 and the right attachment 40 are configured in a bilaterally symmetrical manner. Other than being bilaterally symmetrical, the configuration of the right attachment 40 is substantially the same as the configuration as the left attachment 30 and therefore a detailed description thereof is omitted.

Next, with reference to FIG. 7, a method of fixing the semiconductor light source unit 20 to the left light source mounting portion 15 using the left attachment 30 will be described in detail.

The semiconductor light source unit 20 includes a base portion 21, a left light emitting device 22, a right light emitting device 23, the left power receiving portion 24, and the right power receiving portion 25. Each of the left light emitting device 22 and the right light emitting device 23 is, for example, a white light emitting diode (LED) having a planar light emitting portion on an upper surface of the semiconductor light source unit 20. The left power receiving portion 24 and the right power receiving portion 25 are made of conductive material to serve as contact points, respectively.

The base portion 21 supports the left light emitting device 22, the right light emitting device 23, the left power receiving portion 24 and the right power receiving portion 25. A circuit pattern (not shown) is formed on the base portion 21 to electrically connect the left power receiving portion 24 and the right power receiving portion 25 to the left light emitting device 22 and the right light emitting device 23, respectively.

A notch 21*a* is formed on the left side of the base portion 21. A through-hole 21*b* is formed near the right side of the base portion 21. The notch 21*a* and the through-hole 21*b* are formed to extend completely through the base portion 21 in the up-down direction.

Figure 7:
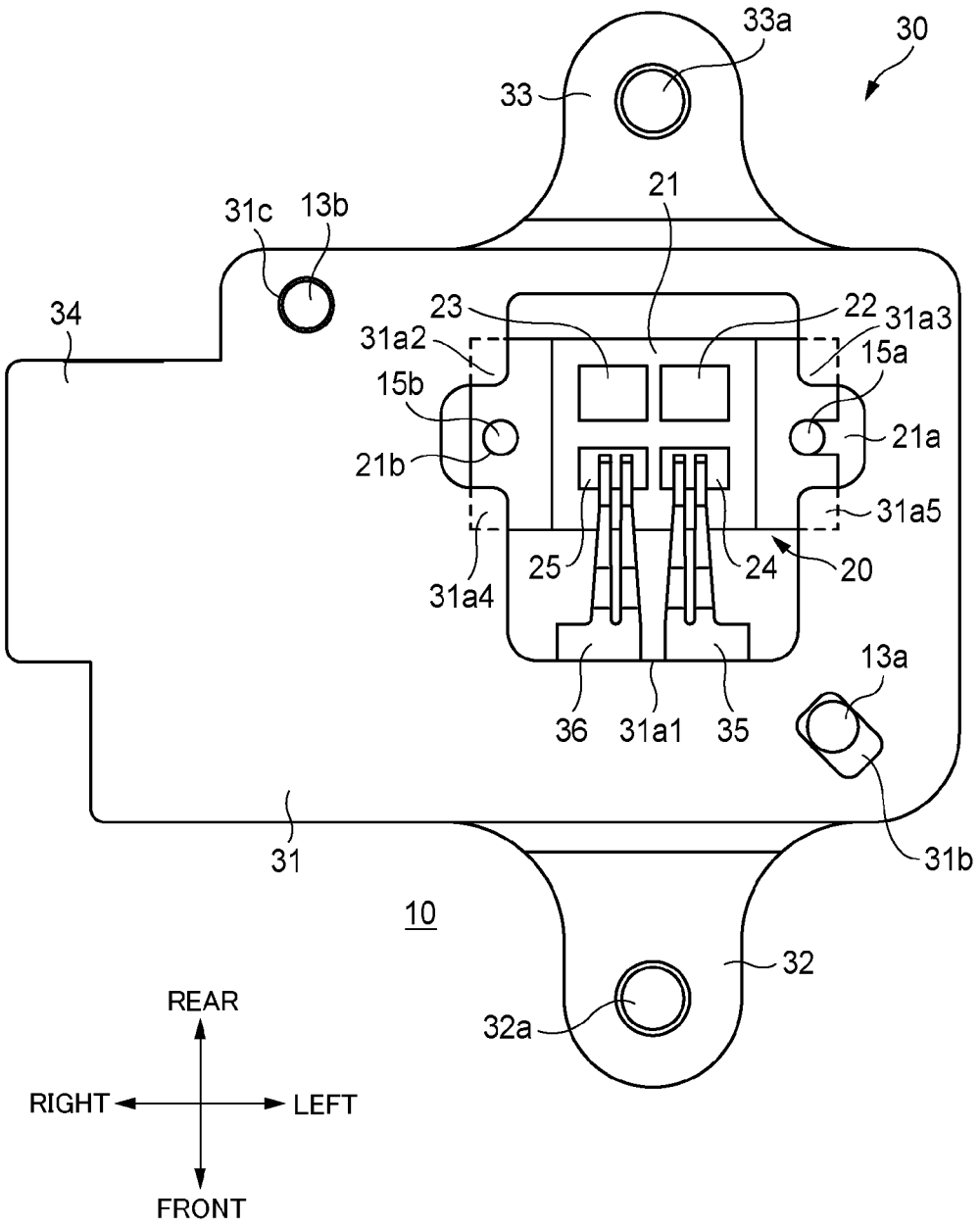
FIG. 7 is a plan view illustrating a positional relationship between the attachment and the semiconductor light source unit.

As shown in FIG. 2 and FIG. 7, the semiconductor light source unit 20 is mounted on the left light source mounting portion 15 such that the left light emitting device 22, the right light emitting device 23, the left power receiving portion 24 and the right power receiving portion 25 are directed upward. When mounting the semiconductor light source unit 20, the left positioning pin 15*a* and the right positioning pin 15*b* (see FIG. 1) are respectively inserted into the notch 21*a* and the through-hole 21*b*, so that the semiconductor light source unit 20 is positioned with respect to the left light source mounting portion 15.

In this state, as shown in FIG. 3, the left attachment 30 is attached from above the semiconductor light source unit 20 that has been mounted on the left light source mounting portion 15. When attaching the left attachment 30, the front positioning pin 13*a* and the rear positioning pin 13*b* (see FIG. 1) are respectively inserted into the front positioning hole 31*b* and the rear positioning hole 31*c*, so that the left attachment 30 is positioned with respect to the support member 10 (the left support section 11).

Further, as shown in FIG. 3, a front fixing screw 37 is inserted through the front fixing hole 32*a* of the front fixing tab 32 and is screwed into the front screw hole 17*a* shown in FIG. 1. Likewise, a rear fixing screw 38 is inserted through the rear fixing hole 33*a* of the rear fixing tab 33 and is screwed into the rear screw hole 17*b* shown in FIG. 1. In this way, the left attachment 30 is secured to the support member 10 (the left support section 11).

A left connector 70 is mounted on the support member 10. The connector 70 is coupled to a signal line for transmitting a signal from a light source controller (not shown). The left connector 70 is fitted into the connecting hole 34*a* of the connector portion 34 provided in the left attachment 30, so that the signal line and the connecting terminals 34*b*, 34*c* are electrically connected to each other.

In this state, as shown in FIG. 7, the left light emitting device 22 and the right light emitting device 23 of the semiconductor light source unit 20 are upwardly exposed to the opening 31*a* of the frame 31 of the left attachment 30. That is, the frame 31 is configured to allow light emitted from the semiconductor light source unit 20 to pass through the opening 31*a*.

In this state, moreover, distal ends (the contact portions 36*c*3) of the pair of arms 36*c* of the right conductive terminal piece 36 are brought into contact with an upper surface of the right power receiving portion 25. Similarly, distal ends (portions corresponding to the contact portions 36*c*3) of the left conductive terminal piece 35 are brought into contact with an upper surface of the left power receiving portion 24. Signals that have been input from the left connector 70 are input to the left light emitting device 22 via the left conductive terminal piece 35 and the left power receiving portion 24. Similarly, signals are input to the right light emitting device 23 via the right conductive terminal piece 36 and the right power receiving portion 25. In this way, the light source controller controls turning on and off of the left light emitting device 22 and the right light emitting device 23.

As shown in FIG. 7, holding portions 31*a*2, 31*a*3, 31*a*4, 31*a*5 of the frame 31 cover corresponding portions of the base portion 21 of the semiconductor light source unit 20 and contact the corresponding portions of the base portion 21 from above. Each of the holding portions 31*a*2, 31*a*3, 31*a*4, 31*a*5 forms an inwardly protruding part of the opening periphery portion that defines the opening 31*a*. The width of the distal end of the inwardly protruding part is narrower than the width of the base end of the inwardly protruding part. The semiconductor light source unit 20 is held on the left light source mounting portion 15 by the holding portions 31*a*2, 31*a*3, 31*a*4, 31*a*5.

As shown in FIG. 3, also with respect to the right light source mounting portion 16, the semiconductor light source unit 20 is positioned with respect to the right light source mounting portion 16 using the left positioning pin 16*a* and the right positioning pin 16*b*. Further, the right attachment 40 is positioned with respect to the support member 10 (the right support section 12) using the front positioning pin 14*a* and the rear positioning pin 14*b*. Furthermore, the right attachment 40 is secured to the support member 10 (the right support section 12) by screwing the front fixing screw 47 and the rear fixing screw 48 into the front screw hole 18*a* and the rear screw hole 18*b*, respectively.

Further, a right connector 80 is connected to a connector portion (a part corresponding to the connector portion 34) of the right attachment 40. Other configurations associated with a relationship between the right attachment 40 and the semiconductor light source unit 20 mounted on the right light source mounting portion 16 are substantially the same as those associated with a relationship between the left attachment 30 and the semiconductor light source unit 20 mounted on the left light source mounting portion 15, and therefore a detailed description thereof is omitted.

Figure 8:
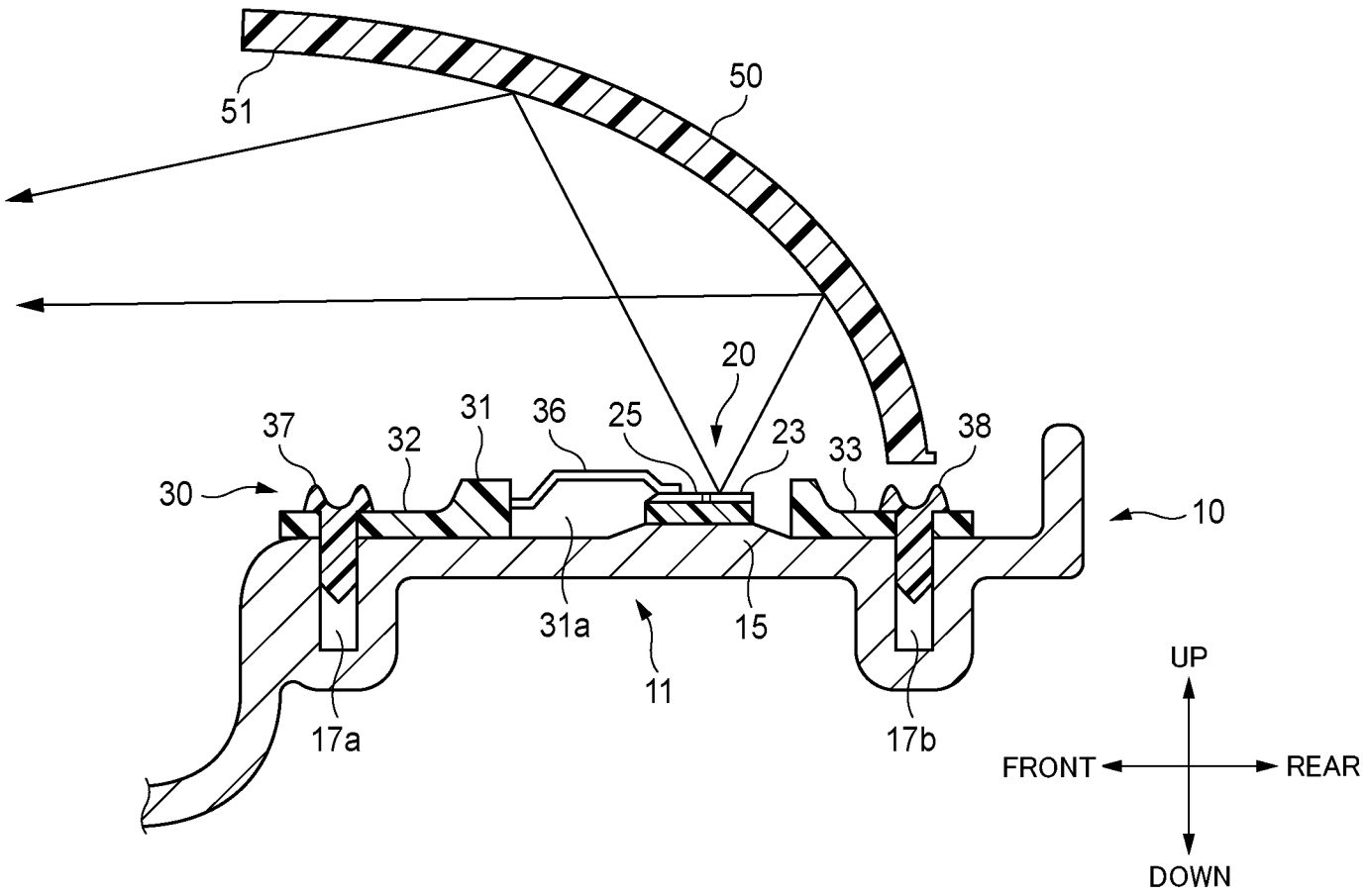
FIG. 8 is a sectional view illustrating a positional relationship between the attachment and the semiconductor light source unit.

FIG. 8 is a vertical sectional view illustrating a positional relationship between the left reflector 50 mounted on the support member 10 as shown in FIG. 4 and the semiconductor light source unit 20 fixed to the left light source mounting portion 15 by the left attachment 30.

The light emitted from the right light emitting device 23 passes through the opening 31*a* and is reflected by the reflecting surface 51 of the left reflector 50 toward the region in front of the semiconductor light source unit 20. The right conductive terminal piece 36 is disposed in front of the semiconductor light source unit 20. The right conductive terminal piece 36 extends in the front-rear direction of the semiconductor light source unit 20 so that the distal end of the right conductive terminal piece 36 contacts the right power receiving portion 25. The left light emitting device 22, the left power receiving portion 24 and left conductive terminal piece 35, which are not shown in FIG. 8, are arranged in a similar manner.

The reflecting surface 51 of the left reflector 50 is configured such that the light reflected by the reflecting surface 51 avoids the left conductive terminal piece 35 and the right conductive terminal piece 36. The reflecting surface 61 of the right reflector 60 is configured in a similar manner.

The support member 10 is made of a material having high thermal conductivity, such as aluminum, to serves as a heat sink that effectively dissipate heat generated due to the light emission of the semiconductor light source unit 20.

As described above, the left attachment 30 (an example of the attachment) according to the exemplary embodiment is configured to fix the semiconductor light source unit 20 to the support member 10 to mount the semiconductor light source unit 20 on a vehicle. The semiconductor light source unit 20 includes the left power receiving portion 24 (an example of the first power receiving portion) and the right power receiving portion 25 (an example of the second power receiving portion). The left attachment 30 includes the frame 31, the left conductive terminal piece 35 (an example of the first conductive terminal piece) and the right conductive terminal piece 36 (an example of the second conductive terminal piece). The frame 31 has the opening periphery portion 31*a*1, 31*a*2, 31*a*3, 31*a*4, 31*a*5 defining the opening 31*a*. The left conductive terminal piece 35 and the right conductive terminal piece 36 extend rearward (an example of one direction) from the front side 31*a*1 of the opening periphery portion to contact the left power receiving portion 24 and the right power receiving portion 25, respectively.

According to the above configuration, the left conductive terminal piece 35 and the right conductive terminal piece 36 extend in the same direction. Therefore, it is possible to use the semiconductor light source unit 20 in which a plurality of power receiving portions is arranged along and near one side of the base portion 21, as shown in FIG. 7. When it is desired to downsize the light source unit, there is a tendency to employ this type of layout of the power receiving portions. Therefore, it is possible to use the semiconductor light source unit 20 that meets the demand for downsizing, and to also reduce the size of the lamp unit 1 accordingly.

As shown in FIG. 7, each of the base end portions of the left conductive terminal piece 35 and the right conductive terminal piece 36 is widened only at the outer side of the base end portion. Accordingly, the inner sides of the base end portions can be provided as close as possible. To further downsize the light source unit, the power receiving portions tends to get closer to each other. Therefore, it is possible to use the semiconductor light source unit 20 that meets the demand for further downsizing, and to also further reduce the size of the lamp unit 1 accordingly.

According to the exemplary embodiment described above, the frame 31 of the left attachment 30 is made of an electrically insulating material. The frame 31 includes the holding portions 31*a*2, 31*a*3, 31*a*4, 31*a*5. Each of the holding portions 31*a*2, 31*a*3, 31*a*4, 31*a*5 contacts the upper surface of the semiconductor light source unit 20 to hold the semiconductor light source unit 20 onto the support member 10.

According to this configuration, it is possible to firmly hold the semiconductor light source unit 20 onto the support member 10. In addition, it is not necessary to perform an insulating treatment on the upper surface of the semiconductor light source unit 20 where the holding portions 31*a*2, 31*a*3, 31*a*4, 31*a*5 abut. Therefore, it is possible to use the semiconductor light source unit 20 manufactured at low cost, and to reduce the cost of the lamp unit 1 accordingly.

Each of the holding portions 31*a*2, 31*a*3, 31*a*4, 31*a*5 forms an inwardly protruding part of the opening periphery portion that defines the opening 31*a* of the frame 31. The width of the distal end of the inwardly protruding part is narrower than the width of the base end of the inwardly protruding part.

According to this configuration, each of the holding portions 31*a*2, 31*a*3, 31*a*4, 31*a*5 can be made flexible, so that each of the holding portions 31*a*2, 31*a*3, 31*a*4, 31*a*5 can be pressed against the semiconductor light source unit 20 with a suitable pressing force. This can stably hold the semiconductor light source unit 20 onto the support member 10.

Further, it is possible to make effective use of a space defined between the adjacent holding portions. For example, according to the exemplary embodiment described above, the positioning pin 15*a* is disposed in a space defined between the holding portions 31*a*3, 31*a*5, and the positioning pin 15*b* is disposed in a space defined between the holding portions 31*a*2, 31*a*4.

The frame 31 includes the front fixing tab 32 (an example of the first fixing tab) and the rear fixing tab 33 (an example of the second fixing tab), both extending parallel to the left conductive terminal piece 35 and the right conductive terminal piece 36. The front fixing tab 32 has the front fixing hole 32*a* (an example of the first through-hole) into which the front fixing screw 37 (an example of the first fastening member) is inserted to fasten the frame 31 to the support member 10. The rear fixing tab 33 has the rear fixing hole 33*a* (an example of the second through-hole) into which the rear fixing screw 38 (an example of the second fastening member) is inserted to fasten the frame 31 to the support member 10. As shown in FIG. 6A, the straight line L1 connecting the centers of the front fixing hole 32*a* and the rear fixing hole 33*a* extends through a space between the left conductive terminal piece 35 and the right conductive terminal piece 36.

According to this configuration, the fastening force by the front fixing screw 37 and the rear fixing screw 38 can be equally applied to the left conductive terminal piece 35 and the right conductive terminal piece 36, so that the contact force of the left conductive terminal piece 35 and the right conductive terminal piece 36 on the left power receiving portion 24 and the right power receiving portion 25 can be made stable and uniform. As a result, an operating condition of the semiconductor light source unit 20 becomes stable.

According to the lamp unit 1 of the exemplary embodiment described above, the left reflector 50 (an example of the reflector) reflects the light emitted from the semiconductor light source unit 20 toward a region in front of the semiconductor light source unit 20. As described above, the direction in which the left conductive terminal piece 35 and the right conductive terminal piece 36 extend corresponds to the front-rear direction of the semiconductor light source unit 20.

In an optical system in which light is irradiated toward a region in front of a light source, it is generally considered that it is better to avoid providing a structure in front of the light source or to the rear of the light source. However, by providing the reflecting surface 51 of the left reflector 50, it is possible to easily control the travelling direction of the light. Accordingly, the lamp unit 1 can be downsized by placing the left conductive terminal piece 35 and the right conductive terminal piece 36 on the front side of the semiconductor light source unit 20 where there is relatively a room for arranging a component.

While the present invention has been described with reference to a certain exemplary embodiment thereof, the scope of the present invention is not limited to the exemplary embodiment described above, and it will be understood by those skilled in the art that various changes and modifications may be made therein without departing from the scope of the present invention as defined by the appended claims.

For example, the semiconductor light source unit 20 may not necessarily use a white light emitting diode, and instead may use a light emitting diode that emits light of a different color or other types of semiconductor light emitting devices such as a laser diode or an organic electroluminescent device.

The shape of the opening 31*a* of the frame 31 can be designed optionally, in so far as the light emitted from the semiconductor light source unit 20 can pass through the opening 31*a*. At least one of the opening periphery portions 31*a*2, 31*a*3, 31*a*4, 31*a*5 may be configured so as not to contact the upper surface of the semiconductor light source unit 20.

In the exemplary embodiment described above, the base end portions of the exposed portions of the left conductive terminal piece 35 and the right conductive terminal piece 36 are both provided on the front side 31*a*1 of the opening periphery portion that defines the opening 31. However, the locations of the respective base end portions of the left conductive terminal piece 35 and the right conductive terminal piece 36 on the periphery portion are optional, in so far as portions of the left conductive terminal piece 35 and the right conductive terminal piece 36, including the contact portions that contact the left power receiving portion 24 and the right power receiving portion 25 respectively, extend in the same direction, that is, in so far as it allows to use a semiconductor light source unit in which power receiving portions are arranged along and near one side of the semiconductor light source unit.

In the exemplary embodiment described above, the left conductive terminal piece 35 and the right conductive terminal piece 36 are disposed in front of the semiconductor light source unit 20. However, the left conductive terminal piece 35 and the right conductive terminal piece 36 may be disposed to the rear of the semiconductor light source unit 20, such that the left conductive terminal piece 35 and the right conductive terminal piece 36 extend in a direction corresponding to the front-rear direction of the semiconductor light source unit 20. Alternatively, the left conductive terminal piece 35 and the right conductive terminal piece 36 may be disposed to the left or to the right of the semiconductor light source unit 20, in so far as the left conductive terminal piece 35 and the right conductive terminal piece 36 extend in the same direction.

The number of the light emitting devices of the semiconductor light source unit 20 may be three or more. In this case, the number of the power receiving portions of the semiconductor light source unit 20 increases in accordance with the number of the light emitting devices, and also the number of the conductive terminal pieces of the attachment increases accordingly. In this case also, the conductive terminal pieces are arranged to extend in the same direction.

The left attachment 30 and the right attachment 40 may not be configured in a bilaterally symmetrical manner. For example, depending on the specifications of the lamp unit 1, the left and right semiconductor light source units 20 may be fixed to the support member 10 using the same attachments.

The left attachment 30 and the right attachment 40 may be fastened to the support member 10 using fastening members other than the front fixing screws 37, 47 and the rear fixing screws 38, 48, in so far as the fastening members can suitably fasten the left attachment and the right attachment to the support member 10.

The number of the semiconductor light source units 20 provided in the lamp unit 1 is not limited to two, and may be one, or three or more.

According to exemplary embodiments of the present invention, the lamp unit 1 may not be configured as a lighting apparatus for vehicle, and may be configured as other lighting apparatuses, for example, a large flashlight.

What is claimed is:

1. An attachment adapted to fix a semiconductor light source unit to a support member, the attachment comprising:

a frame having an opening periphery portion defining an opening to allow light emitted from the semiconductor light source unit to pass through the opening when the semiconductor light source unit is fixed to the support member;

a first conductive terminal piece extending from the opening periphery portion; and a second conductive terminal piece extending from the opening periphery portion, wherein the first conductive terminal piece extends in one direction to contact a first power receiving portion of the semiconductor light source unit when the semiconductor light source unit is fixed to the support member, and wherein the second conductive terminal piece extends in said one direction to contact a second power receiving portion of the semiconductor light source unit when the semiconductor light source unit is fixed to the support member, wherein the frame comprises a holding portion configured to contact an upper surface of the semiconductor light source unit when the semiconductor light source unit is fixed to the support member, the holding portion extending from the opening periphery portion of the frame; and wherein the holding portion is made of an electrically insulating material.

2. The attachment according to claim 1, wherein the first conductive terminal piece and the second conductive terminal piece extend in said one direction from one side of the opening periphery portion.

3. The attachment according to claim 1, wherein a distal end of the inwardly protruding part is narrower than a base end of the inwardly protruding part.

4. The attachment according to claim 1, wherein the frame comprises a first fixing tab and a second fixing tab, each of the first fixing tab and the second fixing tab extending parallel to said one direction, wherein the first fixing tab has a first through-hole into which a first fastening member is inserted to fasten the frame to the support member, wherein the second fixing tab has a second through-hole into which a second fastening member is inserted to fasten the frame to the support member, and wherein a straight line connecting a center of the first through-hole and a center of the second through-hole extends between the first conductive terminal piece and the second conductive terminal piece.

5. A lighting apparatus comprising:

a support member;

a semiconductor light source unit disposed on the support member, the semiconductor light source unit comprising a first power receiving portion and a second power receiving portion; and an attachment provided to fix the semiconductor light source unit to the support member, wherein the attachment comprises a frame having an opening periphery portion defining an opening to allow light emitted from the semiconductor light source unit to pass through the opening;

a first conductive terminal piece extending from the opening periphery portion; and a second conductive terminal piece extending from the opening periphery portion, wherein the first conductive terminal piece extends in one direction to contact the first power receiving portion, and wherein the second conductive terminal piece extends in said one direction to contact the second power receiving portion, and wherein the frame comprises a holding portion configured to contact an upper surface of the semiconductor light source unit when the semiconductor light source unit is fixed to the support member, the holding portion extending from the opening periphery portion of the frame; and wherein the holding portion is made of an electrically insulating material.

6. The lighting apparatus according to claim 5, wherein the first conductive terminal piece and the second conductive terminal piece extend in said one direction from one side of the opening periphery portion.

7. The lighting apparatus according to claim 5, further comprising a reflector to reflect the light emitted from the semiconductor light source unit toward a region in front of the semiconductor light source unit, wherein said one direction corresponds to a front-rear direction of the semiconductor light source unit.

* * * * *